US005670287A

United States Patent [19]

Kawata et al.

[11] Patent Number: 5,670,287

[45] Date of Patent: Sep. 23, 1997

[54] MAGNETIC CARRIER FOR ELECTROPHOTOGRAPHIC DEVELOPING AGENT AND METHOD OF PRODUCING THE SAME

[75] Inventors: Hideaki Kawata; Tomohide Iida; Yoshiteru Hatase; Hidekazu Tamura; Nobuaki Kawano, all of Osaka, Japan

[73] Assignee: Mita Industrial Co., Ltd., Osaka, Japan

[21] Appl. No.: 505,852

[22] Filed: Jul. 24, 1995

[30] Foreign Application Priority Data

Jul. 28, 1994 [JP] Japan ..... 6-195960

[51] Int. Cl.[6] ..... G03G 9/113; G03G 9/107

[52] U.S. Cl. ..... 430/106.6; 430/108; 430/111; 430/137; 428/407

[58] Field of Search ..... 430/137, 108, 430/106.6, 111; 428/407

[56] References Cited

U.S. PATENT DOCUMENTS

| | | | |
|---|---|---|---|
| 4,614,698 | 9/1986 | Miyakawa et al. | 430/106.6 |
| 4,629,673 | 12/1986 | Osawa et al. | 430/108 |
| 5,093,201 | 3/1992 | Ohtani et al. | 430/137 |
| 5,204,204 | 4/1993 | Shintani et al. | 430/108 |
| 5,391,451 | 2/1995 | Yoshie et al. | 430/106.6 |

FOREIGN PATENT DOCUMENTS

| | | |
|---|---|---|
| 0405503 | 1/1991 | European Pat. Off. . |
| 0500054 | 8/1992 | European Pat. Off. . |

*Primary Examiner*—Janis L. Dote

*Attorney, Agent, or Firm*—Sherman and Shalloway

[57] ABSTRACT

A magnetic carrier for electrophotographic developing agent wherein the surfaces of the magnetic core particles are partly coated with a thermosetting resin and a small amount of a low-melting or low-softening thermoplastic resin or wax, and at least recessed portions of the core particles are filled with these coating materials. The magnetic carrier has an electric resistance that is maintained within a range that is suited for forming the image, and suppresses the occurrence of spent toner.

20 Claims, 3 Drawing Sheets

MAGNETIC CARRIER FOR ELECTROPHOTOGRAPHIC DEVELOPING AGENT AND METHOD OF PRODUCING THE SAME

BACKGROUND OF THE INVENTION

1. Field of the Invention

The present invention relates to a magnetic carrier for an electrophotographic developing agent, which prevents the occurrence of spent toner, and has high charge-imparting ability, ability of forming image of high density and excellent durability, and a method of producing the same.

2. Description of the Prior Art

In the art of electrophotography, so far, a magnetic-brush developing method has been widely used for developing electrostatic latent image, and a two-component developing agent consisting of a mixture of a magnetic carrier and a toner has been extensively used for this method.

However, the two-component developing agent has a problem in regard to the occurrence of a so-called spent toner that melt-adheres onto the surfaces of the carrier resulting in a decrease in the charge-imparting ability of the carrier, a decrease in the density of the image and in the occurrence of fogging.

To eliminate such a problem, there has been used a resin-coated carrier as a magnetic carrier for the developing agent in which the surfaces of the magnetic carrier particles are coated with various resins accompanied, however, by such defects that the carrier exhibits large resistance, the charging amount so increases that the image density decreases, and the coated resin is peeled to impair the image quality.

The magnetic carrier particles have ruggedness on the surfaces thereof though they are different to some extent, and some proposals have heretofore been made to fill the ruggedness with a resin or to partly cover the particles with a resin.

According, for instance, to Japanese Laid-Open Patent Publication No. 78138/1979, it has been proposed to fill pores or recessed portions of magnetic cores having large surface coarseness with a fine powder of an electrically insulating resin.

Japanese Laid-Open Patent Publication No. 216260/1983 teaches that whole surfaces of magnetic core particles are coated with a resin and, then, the resin layer is scraped off the protruded portions so that the protruded portions are exposed.

Japanese Laid-Open Patent Publication No. 158339/1986 discloses that recessed portions of carrier particles having recessed portions in the surfaces thereof are filled with a resin powder and, then, the carrier particles are heated to melt-adhere the resin powder.

Japanese Laid-Open Patent Publication No. 93954/1992 discloses a developing agent using a magnetic carrier of fine rugged ferrite particles having a small apparent density coated with a resin in a manner that the protruded portions are exposed.

According to the above-mentioned prior art in which recessed portions of the magnetic core particles are covered with a resin, occurrence of spent toner at the recessed portions is prevented to a certain degree which, however, is not still fully satisfactory from the standpoint of combination of resistance against the occurrence of spent toner and suppression of the toner-charging amount.

That is, with the recessed portions only of the surface being filled with the thermoplastic resin, the spent toner occurs on the portions other than the recessed portions, i.e., on the flat portions and on the protruded portions resulting in a decrease in the charge-imparting ability of the carrier.

When the magnetic core particles are coated with a thermosetting resin, on the other hand, the recessed portions are not filled with the resin to a sufficient degree. Besides, the coating is formed on the whole surfaces of the core particles causing the toner-charging amount to become too great and the image density to become too low.

The method of scraping off the resin layer from the protruded portions to avoid coating over the whole surfaces involves extra cumbersome operation and, besides, permits the resin powder that is scraped off to be mixed into the developing agent arousing various problems. As pointed out already, furthermore, the resin that is not fully buried in the recessed portions will be peeled off during the scrape-off operation.

SUMMARY OF THE INVENTION

An object of the present invention therefore is to provide a magnetic carrier for an electrophotographic developing agent, which prevents the occurrence of spent toner while suppressing the electric resistance from increasing on the carrier surfaces and, as a result, exhibits high charge-imparting ability, ability of forming image of high density and excellent durability, and a method of producing the same.

Another object of the present invention is to provide a method of producing a resin-coated magnetic carrier for an electrophotographic developing agent, which enables the recessed portions of magnetic core particles to be reliably filled with the resin coating and portions other than the recessed portions to be reliably coated with the resin.

According to the present invention, there is provided a magnetic carrier for an electrophotographic developing agent comprising magnetic core particles and a resin-coated layer provided on the surfaces of the core particles, wherein the resin-coated layer chiefly contains a thermosetting resin and contains a small amount of a low-melting or low-softening thermoplastic resin or wax, the resin-coated layer filling at least recessed portions of the core particles and existing as a partial coating layer having a coating area ratio of from 0.1 to 60 % and, particularly, from 5 to 50 %.

According to the present invention, furthermore, there is provided a method of producing a magnetic carrier for an electrophotographic developing agent by applying, to the magnetic core particles, a solution or a dispersion of a resin composition which contains a thermosetting resin and a low-melting or low-softening thermoplastic resin or wax at a weight ratio of from 99.5:0.5 to 51:49, and heating the resin composition on the surfaces of the magnetic core particles at a temperature which is not lower than the melting point of the thermoplastic resin and is not lower than the thermosetting temperature of the thermosetting resin, in order to form a partial coating layer on the surfaces of the magnetic core particles filling at least recessed portions of the core particles.

According to the present invention, the magnetic core particles are coated with a resin composition which chiefly contains a thermosetting resin and a small amount of a low-melting thermoplastic resin or wax. At the time when the thermosetting resin cures, therefore, the low-melting thermoplastic resin or wax weakens the cohesive force of the thermosetting resin or improves fluidity thereof, enabling the recessed portions to be smoothly filled with the resin and the portions other than the recessed portions to be smoothly coated with the partial coating layer.

In the coated carrier of the present invention, the resin-coated layer has resistance against being peeled off owing to anchoring effect obtained by the resin-coated layer that is buried in the recessed portions in the surface of the core. Besides, being chiefly composed of the thermosetting resin, the resin-coated layer exhibits excellent adhesiveness and abrasion resistance, and creates a coating structure having durability as a whole.

Since the coating area ratio on the whole surfaces of the magnetic core particles is limited to lie within the above-mentioned range, it is allowed to suppress the occurrence of spent toner while maintaining the electric resistance of the magnetic carrier to lie within a proper range. As a result, there is provided a magnetic carrier for an electrophotographic developing agent which has high charge-imparting ability and image-forming ability maintaining high density, and exhibiting excellent durability as well.

DETAILED DESCRIPTION OF TEE INVENTION

Figure 1:
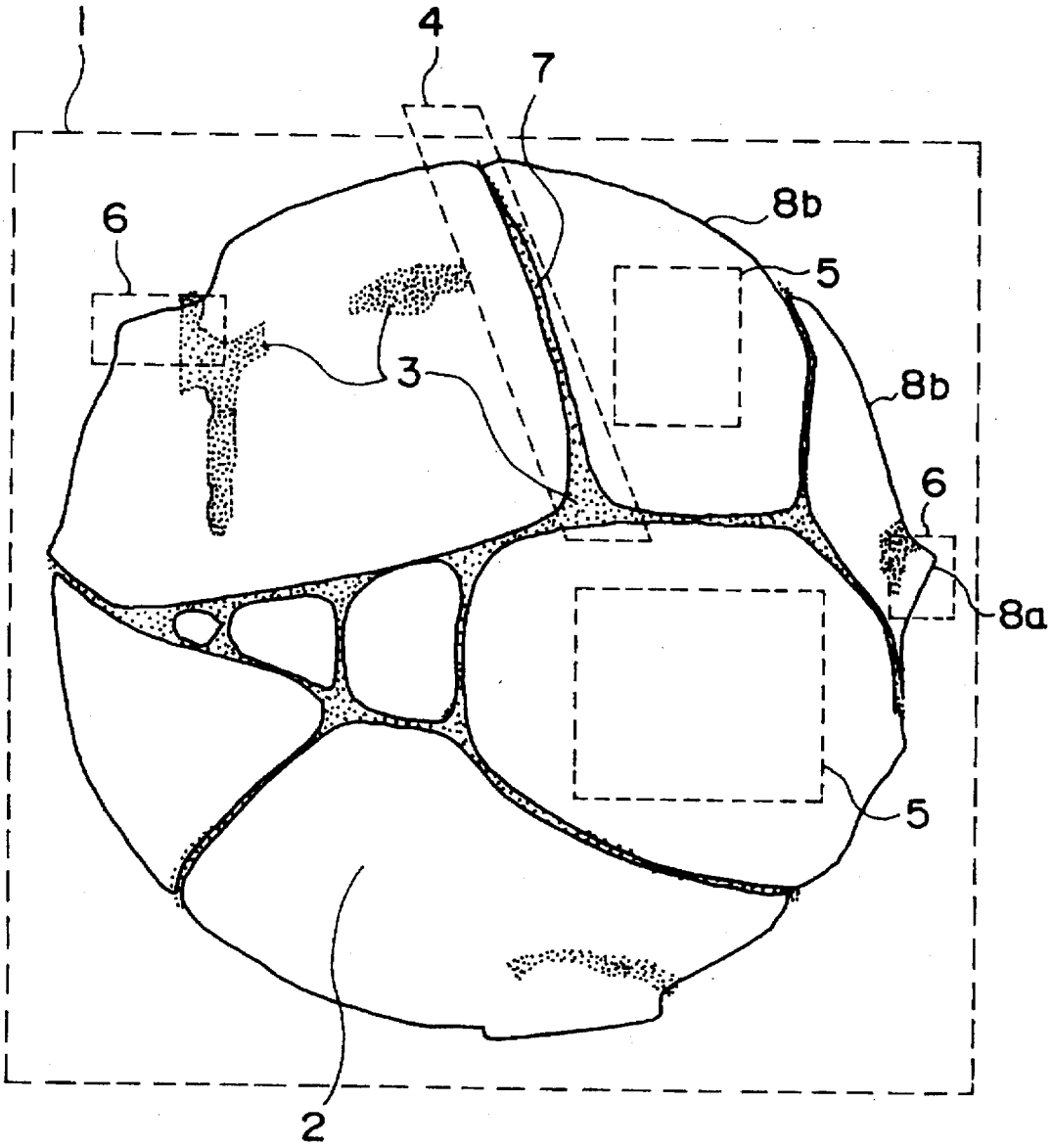
FIG. 1 is a side view illustrating, on an enlarged scale, the surface structure of a coated magnetic carrier of the present invention.

According to the present invention, a first feature resides in that the magnetic core particles are coated with a resin composition which contains chiefly a thermosetting resin and contains a small amount of a low-melting or low-softening thermoplastic resin or wax.

In this specification, the low-melting or the low-softening stands exclusively for a melting point when the melting point is obvious and stands for a softening point when the melting point is not obvious.

It was found that the recessed portions of magnetic core particles can be effectively filled with the resin and surfaces other than the recessed portions can be provided with a resin-coated layer in a partly covered form when the magnetic core particles are coated with the thermosetting resin which is blended with a small amount of the low-melting or low-softening thermoplastic resin or wax.

The thermosetting resin adheres intimately to the magnetic core particles and the coating thereof exhibits excellent heat resistance and abrasion resistance. When the magnetic core particles are coated with the thermosetting resin, however, they are coated over the whole surfaces thereof; i.e., recessed portions in the surfaces are not filled with the thermosetting resin to a sufficient degree. When the thermosetting resin is blended with a small amount of a low-melting or low-softening thermoplastic resin, on the other hand, the thermoplastic resin weakens the cohesive force of the thermosetting resin and improves fluidity thereof at the time when the thermosetting resin is cured, enabling the recessed portions to be smoothly filled with the resin and portions other than the recessed portions to be provided with a partly coated layer. It is considered that the recessed portions are filled with the resin and partial coating is formed not only due to a difference in the cohesive force during the heating but also due to the facts that the thermosetting resin has a large density whereas the thermoplastic resin has a small density creating a distribution structure in which the thermosetting resin is distributed downwardly and the thermoplastic resin is distributed upwardly and that the thermosetting resin has functional groups at a concentration higher than that of the thermoplastic resin and bonds well to the surfaces of the core particles.

According to the present invention, a second feature resides in that the resin coating of the magnetic carrier effectively flows into the recessed portions of core particles and exists as a partial coating layer having a coating area ratio of from 0.1 to 60% and, desirably, from 1.0 to 50% and, most desirably, from 5 to 45%.

That is, with the coated carrier of the present invention, the resin-coated layer has resistance against being peeled off owing to anchoring effect obtained by the resin-coated layer that is fitted into the recessed portions in the surface of the core. Besides, being chiefly composed of the thermosetting resin, the resin-coated layer exhibits excellent adhesiveness and abrasion resistance, and creates a coating structure having durability as a whole.

Since the coating area ratio on the whole surfaces of the magnetic core particles is limited to lie within the above-mentioned range, it is allowed to suppress the occurrence of spent toner while maintaining the electric resistance of the magnetic carrier to lie within a proper range. When coated with the thermosetting resin, the magnetic core particles tend to be coated over the whole surfaces as pointed out already. In this case, the surface resistance of the coated carrier reaches the order of $3.0\times10^9$ Ω. With the coated carrier of the present invention, however, the electric resistance is suppressed to be smaller than that of the above-mentioned carrier which is coated over the whole surfaces thereof by about tens to hundreds of times, preventing the potential of charge of the toner from becoming too great.

In the partly-coated carrier of the present invention, the coating area ratio is specified to be from 0.1 to 60%. This is because, when the coating area ratio is smaller than the above range, the spent toner occurs in increased amounts. When the coating area ratio is larger than the above range, on the other hand, the electric resistance of the magnetic carrier becomes so large that the image density decreases during the developing.

It is desired that the thermosetting resin and the thermoplastic resin or wax are used at a weight ratio of from 99.5:0.5 to 51:49 and, particularly, from 99:1 to 90:10. When the amount of use of the thermoplastic resin is smaller than the above-mentioned range, recessed portions of core particles are not reliably filled with the resin or the partial coating layer is not formed reliably. When the amount of the thermoplastic resin is larger than the above-mentioned range, on the other hand, the ratio of the thermosetting resin decreases causing the layer that is formed to lose heat resistance, abrasion resistance and durability. It is an astonishing fact that the above-mentioned effects are obtained by the use of the thermoplastic resin in an amount as small as from 1 to 10%.

It is desired that the thermoplastic resin or wax has a melting point or a softening point lower than a thermosetting temperature of the thermosetting resin from the standpoint of filling the recessed portions and forming a partial coating layer. In general, it is desired that the thermoplastic resin or wax has a melting point or a softening point which is lower than 150° C. from the standpoint of effectively developing the aforementioned functions.

The amount of coating the magnetic core particles with the resin composition is usually from 0.01 to 2.0% by weight, desirably, from 0.05 to 1.5% by weight most desirably, from 0.1 to 1.0% by weight. When the amount of coating exceeds the above-mentioned range, it becomes difficult to form a partial coating layer and when the amount of coating becomes smaller than the above-mentioned range, the coating area ratio fails to reach the range of the present invention and the durability of the coating tends to decrease. To increase the amount of coating, it is desired to increase the blending amount of the low-melting or low-softening resin.

Figure 2:
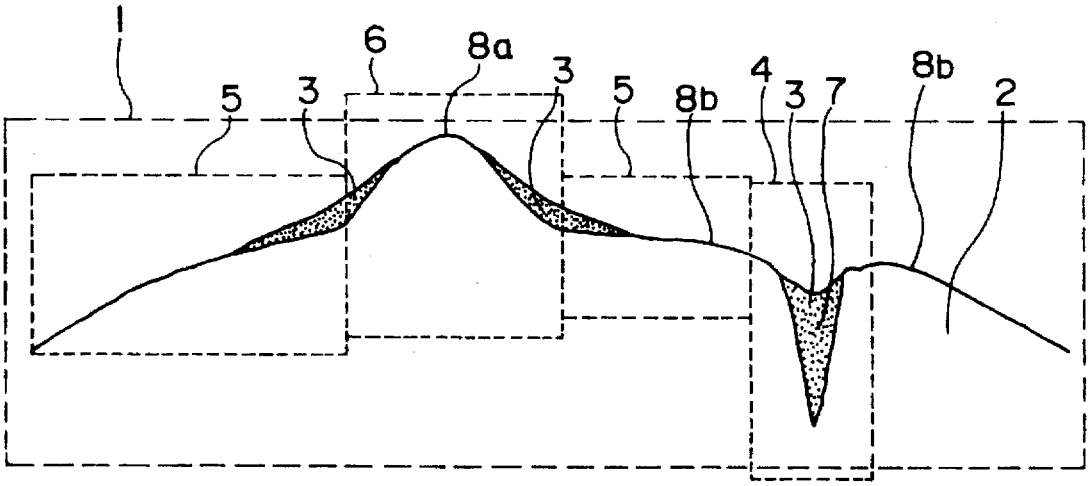
FIG. 2 is a sectional view of the coated magnetic carrier of the present invention on an enlarged scale.
Figure 3:
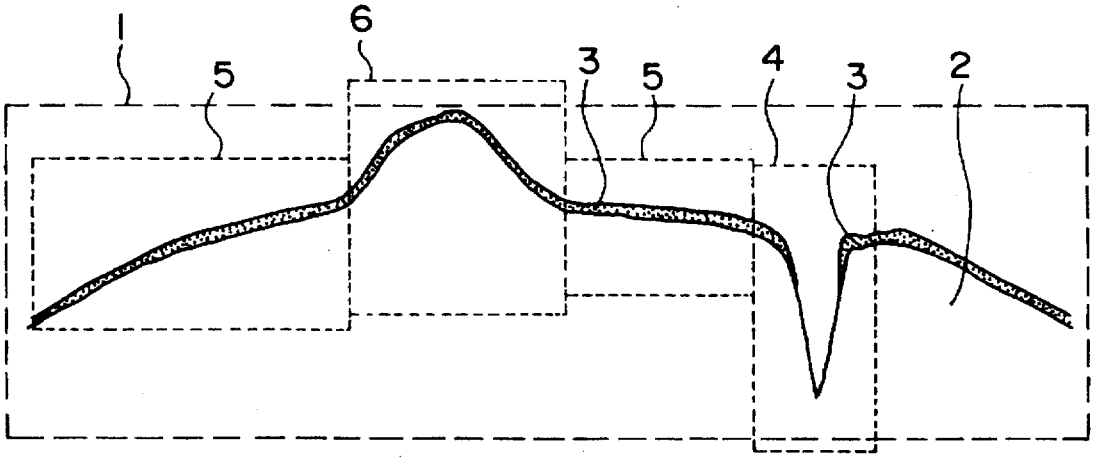
FIG. 3 PRIOR ART
FIG. 3 is a sectional view of a conventional coated magnetic carrier on an enlarged scale.

Referring to FIG. 1 (side view of an enlarged scale) and FIG. 2 (sectional view of an enlarged scale) illustrating the surface structure of the coated magnetic carrier of the present invention, a coated magnetic carrier particle 1 comprises a magnetic core particle 2 and a resin-coated layer 3. The surface of the magnetic core particle 2 includes recessed portions 4, relatively flat portions 5 and summit portions 6. In the coated magnetic carrier of the present invention, the layer 7 of resin exists necessarily and reliably in the recessed portions 4, and the flat portions 5 and summit portions 6 necessarily include exposed portions 8*a*, 8*b* where the surfaces of the carrier are exposed, and the resin-coated layer 3 is a partial coating layer. In the coated magnetic carrier using a thermosetting resin of the prior art as shown in FIG. 3 (sectional view of an enlarged scale), on the other hand, the resin does not fully flow into the recessed portions 4, and the flat portions 5 and the summit portions 6 are coated with the resin as a continuous layer. In the coated magnetic carrier 1 of the present invention shown in FIG. 2, the coated layer is broken on the exposed portions 8*a*, 8*b* due to destruction of cohesion of the low-melting thermoplastic resin during the thermosetting; i.e., partial coating layer is formed.

[Magnetic core particles]

Figure 4:
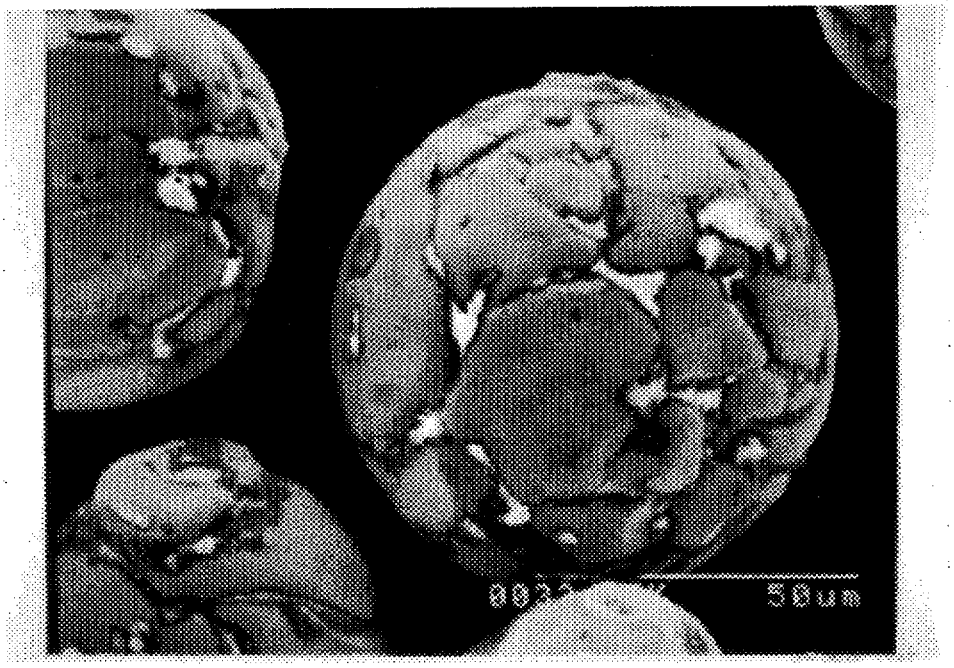
FIG. 4 is an electron microphotography (magnification of 800 times) illustrating the particle structure of a ferrite magnetic core having ruggedness in the surface.

The magnetic core particles used in the present invention has recessed portions in the surface and generally comprise a widely known magnetic material such as sintered ferrite, magnetite or iron powder and, desirably, comprise sintered ferrite. The presence of ruggedness in the surface can be observed by using an electron microscope. The accompanying FIG. 4 is an electron microphotograph (magnification of 800 times) showing the structure of a magnetic ferrite core having ruggedness in the surface.

Though there is no particular limitation, the diameter of the magnetic core particles is generally from 30 to 200 μm and is, particularly, from 50 to 150 μm as measured by using an electron microscope, and the size of the recessed portions is from 0.01 to 20 μm and, particularly, from 0.1 to 15 μm in terms of a maximum diameter. The apparent density of the magnetic core particles is generally from 2.55 to 2.95 g/cc and, particularly, from 2.65 to 2.85 g/cc though it may vary depending upon the surface structure or the particle diameter. Moreover, it is desired that the saturation magnetization of the magnetic core particles is from 40 to 70 Oe and, particularly, from 45 to 65 Oe.

The magnetic core particles are obtained by granulating a magnetic starting material having fine particle sizes of generally of the order of submicrons by such means as spray granulation followed by sintering by such means as firing. The particles, however, have recessed portions or wrinkles in the surfaces due to primary particles which are yet maintaining outer shapes on the surfaces or due to shrinking during the sintering.

Any widely known magnetic powder can be used for producing the magnetic core particles. Examples include ferromagnetic iron oxides such as tri-iron tetroxide ($Fe_3O_4$), iron sesquioxide ($\gamma$-$Fe_2O_3$), etc., ferrites such as zinc ion oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), neodium iron oxide ($NdFeO_3$), barium iron oxide ($BaFe_{12}O_{19}$), manganese iron oxide ($MnFe_2O_4$), lanthanum iron oxide ($LaFeO_3$) or composites thereof, or ferromagnetic metals such as iron powder (Fe), cobalt powder (Co), nickel powder (Ni), etc. or alloys thereof, which may be used in one kind or in a combination. There is no particular limitation in the shape of the magnetic particles which, therefore, may have any shape such as spherical shape, cubic shape or amorphous shape.

The magnetic cores may have a high electric resistance or a low electric resistance. Usually, however, the magnetic cores having a volume resistivity of from $10^5$ to $10^9$ Ω·cm and, particularly, from $10^7$ to $10^8$ Ω·cm are used.

[Resin-coated layer]

It is important that the resin-coated layer used in the present invention comprises a resin composition which contains a thermosetting resin and a small amount of a low-melting or low-softening thermoplastic resin or wax, from the standpoint of effectively filling the recessed portions and forming a partial coating.

As the thermosetting resin, any thermosetting resin can be used that has heretofore been used for the production of the coated magnetic carriers, such as modified or unmodified silicone resin, thermosetting acrylic or acrylic-styrene resin, phenol resin, urethane resin, thermosetting polyester resin, epoxy resin or amino resin, which may be used in one kind or in two or more kinds.

From the standpoint of heat resistance, durability and abrasion resistance, it is desired that the thermosetting resin has a gel percentage of not smaller than 55% and, particularly, not smaller than 65% as measured by using a tetrahydrofurane as the solvent. The gel percentage is given by the following relation, $$\text{Gel percentage} = \frac{\text{Insoluble resin component}}{\text{Resin component}} \times 100$$

Functional groups in the thermosetting resin not only affect the curing properties of the resin but also greatly affect the charging polarity of the magnetic carrier. That is, the resins containing nitrogen such as amino group or the like group are generally charged into positive polarity and the resins containing oxygen such as hydroxyl group or carboxyl group are generally charged into negative polarity. Resins charging into positive polarity can be represented by amino resins and amino group-containing acrylic resins, and resins charging into negative polarity can be represented by silicone resins, carboxyl group-containing acrylic resins and phenol resins. By selecting combinations of functional groups of the thermosetting resins, it is allowed to obtain suitable curing property and charging property.

A particularly preferred thermosetting resins can be represented by a modified silicone resin. The modified silicone resin is obtained by modifying a polyorganosiloxane with an acrylic resin, phenol resin, epoxy resin or amino resin to impart curing property and suitable charging property.

As the low-melting or low-softening thermoplastic resin or wax, there is used a thermoplastic resin or wax having a melting point or a softening point lower than the thermosetting temperature of the thermosetting resin that is used, and, particularly, a thermoplastic resin or wax having a melting point or a softening point which is not higher than 150° C.

The thermoplastic resin or wax having a low melting point or a low softening point should be compatible with, or dispersed in, the thermosetting resin. The thermoplastic resin or wax in the state of a paint should be capable of being applied uniformly and should so behave as to form partial coatings being driven out from the thermosetting resin during the curing. In this sense it is desired that the thermoplastic resin or wax that is used has a polar group in the molecular chains thereof.

Examples of the polar groups include ester, amide, imide group, carboxyl group, acid anhydride group, keto group, hydroxyl group, amino group, ether group and epoxy group. It is desired that these polar groups are contained at a concentration of from 1 to 1200 millimols/100 g and, particularly, from 10 to 1000 millimols/100 g.

Preferred examples include thermoplastic acrylic or acrylic styrene resin, ethylene copolymer resin, low-melting polyamide resin or low-melting polyester resin.

In the present invention, the thermoplastic acrylic resin chiefly contains acrylic ester or methacrylic ester and is, as desired, copolymerized with a comonomer having a functional group such as carboxyl group, hydroxyl group, amino group or epoxy group.

Examples of the acrylic ester or methacrylic ester include methyl (meth)acrylate, ethyl (meth)acrylate, isopropyl (meth)acrylate, n-butyl (meth)acrylate, isobutyl (meth) acrylate, n-amyl (meth)acrylate, isoamyl (meth)acrylate, n-hexyl (meth)acrylate, 2-ethylhexyl (meth)acrylate, and n-octyl (meth)acrylate. Here, the above-mentioned (meth) acrylic acid stands for an acrylic acid or a methacrylic acid.

The carboxyl group-containing monomer will be an ethylenically unsaturated carboxylic acid or an anhydride thereof such as acrylic acid, methacrylic acid, crotonic acid, maleic acid, fumaric acid, itaconic acid, citraconic acid, maleic anhydride or itaconic anhydride.

Examples of the hydroxyl group-containing monomer include β-hydroxypropyl ester and γ-hydroxyethyl ester of acrylic acid or methacrylic acid, and hydroxymethylolated product of acrylamide.

Examples of the amino group-containing monomer include β-aminopropyl ester and γ-aminoethyl ester of acrylic acid or methacrylic acid, and N-2-aminoethylaminoethyl ester.

Examples of the epoxy group-containing monomer include glycidyl ester and allyl glycidyl ether of acrylic acid and methacrylic acid.

Other comonomers to be copolymerized with these monomers include styrene, vinyl toluene, acrylonitrile, methacrylonitrile, etc. The acrylic resin that is used should have a molecular weight large enough for forming a film.

As the ethylene copolymer resin or wax, there can be exemplified acid-modified polyethylenes such as an ethylene-vinyl acetate copolymer, an ethylene-(meth)acrylic ester copolymer, a maleic anhydride-grafted polyethylene, as well as ionomer, oxidized polyethylene wax, acid-modified polyethylene wax, etc.

As the low-melting polyamide resin, there can be used a low-melting or low-softening copolymerized amide resin obtained by copolymerizing plural kinds of ω-aminocarboxylic acids or diamine/dicarboxylates. In general, there can be used those obtained by copolymerizing nylon 6 or nylon 6,6 with ω-aminocarboxyli c acid having 10 or more carbon atoms, such as dimeric acid, ω-aminolauric acid, or with a diamine/dicarboxylate having 10 or more carbon atoms, such as dodecane diamine or dodecane dicarboxylic acid.

As the low-melting polyester resin, there can be used a low-melting or low-softening copolymerized polyester resin obtained by copolymerizing plural kinds of ω-hydroxycarboxylic acids or diol/dicarboxylic acids. In general, there can be used those obtained by copolymerizing an ethylene glycol and a terephthalic acid with a polyethylene glycol such as diethylene glycol or the like, diols such as bisphenols, aliphatic dicarboxylic acid such as adipic acid, or isophthalic acid.

The thermoplastic resin or wax used in the present invention may also work as a high-molecular charge-controlling agent, and may be blended with an ordinary charge-controlling agent in addition to thermosetting resin and thermoplastic resin or wax.

The resin composition for coating contains the above-mentioned thermosetting resin and the low-melting thermoplastic resin or wax at a weight ratio of from 99.5:0.5 to 51:49 and, particularly, from 99:1 to 90:10.

[Coated magnetic carrier and method of producing the same]

In the present invention, the resin composition is applied onto the surface of the magnetic core particles so that at least recessed portions of the core particles are filled with the resin and that the resin composition exists as a partial coating layer having a coating area ratio of coating layer of from 0.1 to 60%, particularly, from 1.0 to 50% and, most particularly, from 5.0 to 45%.

For this purpose, a solution or a dispersion of the resin composition that contains the thermosetting resin and the low-melting or low-softening thermoplastic resin at the above-mentioned weight Patio is applied to the magnetic core particles to form a coating layer of the resin composition on the surfaces of the magnetic core particles. In this step, the resin-coated layer on the surface of the magnetic core particles may exist in the form of a continuous layer.

Examples of the organic solvent for the coating solution include aromatic hydrocarbon solvents such as toluene, xylene, etc.; ketone solvents such as acetone, methyl ethyl ketone, methyl isobutyl ketone, cyclohexanone, etc.; cyclic ethers such as tetrahydrofurane, dioxane, etc.; alcohol solvents such as ethanol, propanol, butanol, etc.; cellosolve solvents such as ethyl cellosolve, butyl cellosolve, etc.; ester solvents such as ethyl acetate, butyl acetate, etc.; amide solvents such as dimethyl formamide, dimethyl acetamide, etc., which may be used in one kind or in two or more kinds. It is generally desired that the resin concentration in the starting solution is from 0.001 to 50% by weight and, particularly, from 0.01 to 30% by weight.

It is desired that the resin-coated layer is provided in an amount of from 0.01 to 2.0% by weight, preferably, from 0.05 to 1.5% by weight and, most preferably, from 0.1 to 1.0% by weight reckoned as a solid component with respect to the magnetic core particles.

The resin composition is applied onto the magnetic core particles by immersion coating, spray coating, or spray coating based upon the moving bed or the fluidized bed.

Next, the resin composition on the surfaces of the magnetic core particles is heated at a temperature higher than the melting point or the softening point of the thermoplastic resin or wax and higher than the thermosetting temperature of the thermosetting resin. In this stage, a partial coating is formed on the surface of the magnetic core particles to at least fill the recessed portions of the core particles, and the thermosetting resin is cured to a sufficient degree.

The resin-coated layer on the surfaces of the magnetic core particles is usually cured by the hot air but the heating is often effected relying upon heating with stirring, infrared-ray heating, heating by the conduction of heat or heating by the fluidized bed.

The heating temperature is as described above but is usually from 100°to 300° C. and is effected for about 5 to about 300 minutes.

The coated cores that are obtained are, as required, digested to a slight degree so as to loosen the aggregation, classified, and are cooled to obtain a product.

EXAMPLES

The invention will now be described by way of examples.

Example 1

Preparation of a carrier.

Into 1000 parts by weight of spherical ferrite particles having an average particle diameter of 100 μm which are magnetic core particles was mixed the coating agent of the following components by using a heatin g/stirring device. Thereafter, the solvent was dried, and the mixture was heat-treated at 200° C. for one hour to obtain a carrier for electrophotography.

(Coating agent)

Acrylic-modified silicone resin: 4.9 parts by weight Thermoplastic styrene-acrylic resin (softening point: 108° C.): 0.1 part by weight Solvent (toluene): 200 parts by weight

Example 2

A carrier for electrophotography was prepared in the same manner as in Example 1 but changing the resin components in the coating agent into:

Acrylic-modified silicone resin: 0.098 parts by weight Thermoplastic styrene-acrylic resin (softening point: 108° C.): 0.002 parts by weight.

Example 3

A carrier for electrophotography was prepared in the same manner as in Example 1 but changing the resin components in the coating agent into:

Acrylic-modified silicone resin: 19.6 parts by weight Thermoplastic styrene-acrylic resin (softening point: 108° C.): 0.4 parts by weight.

Example 4

A carrier for electrophotography was prepared in the same manner as in Example 1 but changing the resin components in the coating agent into:

Melamine resin: 0.98 parts by weight Thermosetting styrene-acrylic resin: 3.92 parts by weight. Thermoplastic styrene-acrylic resin (softening point:108° C.): 0.10 parts by weight.

Example 5

A carrier for electrophotography was prepared in the same manner as in Example 1 but changing the resin components in the coating agent into:

Melamine resin: 0.98 parts by weight

Thermosetting polyester resin: 3.92 parts by weight Thermoplastic styrene-acrylic resin (softening point: 108° C.): 0.1 part by weight.

Example 6

A carrier for electrophotography was prepared in the same manner as in Example 1 but changing the resin components in the coating agent into:

Melamine resin: 0.98 parts by weight

Acrylic-modified silicon resin: 3.92 parts by weight Thermoplastic styrene-acrylic resin (softening point: 108° C): 0.1 part by weight.

Example 7

A carrier for electrophotography was prepared in the same manner as in Example 1 but changing the resin components in the coating agent into:

Acrylic-modified silicone resin: 4.9 parts by weight

Polyethylene wax (m.p. 128° C.): 0.1 part by weight.

Example 8

A carrier for electrophotography was prepared in the same manner as in Example 1 but using a thermoplastic styrene-acrylic resin having a softening point of 154 ° C. in the coating agent.

Example 9

A carrier for electrophotography was prepared in the same manner as in Example 1 but using a spherical ferrite carrier having an average particle diameter of 50 μm as magnetic core particles.

Example 10

A carrier for electrophotography was prepared in the same manner as in Example 1 but using a spherical ferrite carrier having an average particle diameter of 150 μm as magnetic core particles.

Comparative Example 1

Magnetic core particles used in Example 1 were directly used as a carrier for electrophotography.

Comparative Example 2

A carrier for electrophotography was prepared in the same manner as in Example 1 but changing the resin components in the coating agent into:

Acrylic-modified silicone resin: 0.0098 parts by weight

Thermoplastic styrene-acrylic resin(softening point:108° C.): 0.0002 parts by weight.

Comparative Example 3

A carrier for electrophotography was prepared in the same manner as in Example 1 but changing the resin components in the coating agent into:

Acrylic-modified silicone resin: 24.5 parts by weight Thermoplastic styrene-acrylic resin(softening point:108° C.): 0.5 parts by weight.

Comparative Example 4

A carrier for electrophotography was prepared in the same manner as in Example 1 but changing the resin components in the coating agent into:

Acrylic-modified silicone resin: 5 parts by weight.

Comparative Example 5

A carrier for electrophotography was prepared in the same manner as in Example 1 but changing the resin components in the coating agent into:

Acrylic-modified silicone resin: 2.5 parts by weight Thermoplastic styrene-acrylic resin(softening point:108° C.): 2.5 parts by weight.

Experimental Example

Preparation of toner A.

The following components were mixed together, melt-kneaded, cooled, pulverized and were classified to obtain toner particles having an average particle diameter of 10 μm. Surfaces of the toner particles were treated with a hydrophobic silica having a diameter of 0.015 μm in an amount of 0.3 parts by weight per 100 parts by weight of the toner particles, in order to obtain a toner A.

(Toner composition)

Fixing resin (styrene-acrylic copolymer): 100 parts by weight

Carbon black: 10 parts by weight

Parting agent (polypropylene wax): 3 parts by weight

Charge-controlling agent (chromium complex): 2 parts by weight

Preparation of toner B.

The following components were mixed together, melt-kneaded, cooled, pulverized and were classified to obtain toner particles having an average particle diameter of 10 μm. Surfaces of the toner particles were treated by adding, as spacer particles, magnetite particles having an average particle diameter of 0.4 μm in an amount of 0.5 parts by weight and adding a hydrophobic silica having a diameter of 0.015 μm in an amount of 0.3 parts by weight per 100 parts by weight of the toner particles, in order to obtain a toner B.

(Toner composition)

Fixing resin (styrene-acrylic copolymer having a carboxyl group: acid value 10): 100 parts by weight Carbon black (dispersion pH 3.5, BET specific surface area 134 $m^2/g$, DBP oil-absorbing amount 100 ml/100 g): 7 parts by weight Magnetic powder (magnetite): 2 parts by weight Preparation of developing agent.

Carriers of Examples and Comparative Examples each in an amount of 96.5 parts by weight and the above-mentioned toner A in an amount of 3.5 parts by weight were mixed and stirred together to prepare two-component developing agents.

Furthermore, 96.5 parts by weight of the carrier of Example 1 and 3.5 parts by weight of the above-mentioned toner B were mixed and stirred together to prepare a two-component developing agent (Example 11).

Experiment

The above-mentioned developing agents were used as starting agents for an electrostatic copying machine (Model DC-4685 manufactured by Mita Kogyo Co.). Being replenished with the same toners, 80,000 pieces of copies were continuously obtained to take the following measurements. The results were as shown in Tables 1 and 2.

The resin area ratios and electric resistances of the carriers used for the experiment were measured in compliance with the following methods, and the results were also shown in Tables 1 and 2.

Measurement of coating area ratio.

The carrier particles were photographed by using an electron microscope, the areas of the carrier particles and the areas of the resin covering the carrier surfaces were measured by using an image analyzer, and the ratio of the areas was calculated as a coating area ratio (%).

Measurement of electric resistance.

The carrier obtained in Examples or Comparative Examples was introduced in an amount of 200 mg between the electrodes spaced apart by 2 mm and magnets of 1500 gausses were brought close to both sides of the electrodes to create a bridge of carrier between the electrodes, and a voltage of 1000 V was applied across the electrode plates to measure the electric resistance. Measurement of the amount of charge of the developing agent.

The blow-off amount of charge (μC/g) of the developing agent was measured by using a "Blow-Off Powder Charge Measuring Device" produced by Toshiba Chemical Co.

Measurement of image density.

The density (I.D.) of a black solid portion in the copied image was measured by using a reflection densitometer (model "TC-6D", manufactured by Tokyo Denshoku Co.).

Measurement of fogging density.

The density of the non-image portion in a copied image was measured by using the above reflection densitometer and a difference from a base paper (density of the paper of before being copied) was regarded to be a fogging density (F.D.).

Transfer efficiency.

The amount of toner in the toner hopper of prior to starting the copying and the amount of toner in the toner hopper after a predetermined number of pieces were copied were measured, and the consumption of toner was calculated from the difference. At the same time, the amount of toner recovered in the step of cleaning while the predetermined number of copies were obtained, was measured to find the amount of toner recovered. From these values, the toner transfer efficiency was calculated in compliance with the following formula.

$$\text{Transfer efficiency (\%)} = \frac{\text{(Amount of toner consumed)} - \text{(Amount of toner recovered)}}{\text{(Amount of toner consumed)}} \times 100$$

Scattering of toner.

The scattered state of toner in the copying machine after 100,000 pieces of copies were obtained was observed by naked eyes, and was evaluated on the following basis.

○: Toner did not scatter.

X: Toner scattered.

Amount of spent

The developing agent after the copies were continuously obtained was placed on a sieve of 400 mesh, and was separated into the toner and the carrier by being blown from the lower side. Five grams of the carrier left on the sieve was introduced into a beaker followed by the addition of toluene, so that the toner adhered on the surfaces of the carrier was dissolved. Then, the toluene solution was discarded away in a state where the carrier was attracted by a magnet from the lower side of the beaker. This operation was repeated several times until the toluene became colorless. The toluene was then dried on an oven to measure the weight. A difference between the weight contained in the beaker and the weight after drying is the amount of spent. The amount of spent was expressed in terms of milligrams of the spent toner adhered per a gram of the carrier.

TABLE 1

| | Examples | | | | | | | | | | |
|---|---|---|---|---|---|---|---|---|---|---|---|
| | 1 | 2 | 3 | 4 | 5 | 6 | 7 | 8 | 9 | 10 | 11 |
| Coating area ratio (%) | 15.3 | 0.30 | 58.8 | 22.5 | 21.9 | 18.7 | 18.2 | 18.5 | 16.2 | 15.3 | 15.3 |
| Electric resistance (Ω) | $1 \times 10^8$ | $5 \times 10^7$ | $6 \times 10^9$ | $4 \times 10^8$ | $5 \times 10^8$ | $2 \times 10^8$ | $4 \times 10^8$ | $2 \times 10^8$ | $1 \times 10^8$ | $2 \times 10^8$ | $1 \times 10^8$ |
| Amount of charge (μC/g) | | | | | | | | | | | |
| First | −19.8 | −20.2 | −18.3 | −18.2 | −18.7 | −20.2 | −18.9 | −22.4 | −18.0 | −20.5 | −18.4 |
| After 10,000 pieces | −20.0 | −22.4 | −19.7 | −20.3 | −20.8 | −22.2 | −20.4 | −23.8 | −20.2 | −22.6 | −19.7 |
| After 40,000 pieces | −24.4 | −24.0 | −22.4 | −23.1 | −23.0 | −23.5 | −23.3 | −24.5 | −22.3 | −24.2 | −24.3 |
| After 80,000 pieces | −23.3 | −23.8 | −25.5 | −24.0 | −25.2 | −22.0 | −22.8 | −24.6 | −23.0 | −23.4 | −24.3 |
| Image density | | | | | | | | | | | |
| First | 1.42 | 1.43 | 1.41 | 1.43 | 1.42 | 1.42 | 1.44 | 1.44 | 1.40 | 1.42 | 1.43 |
| After 10,000 pieces | 1.40 | 1.40 | 1.35 | 1.41 | 1.38 | 1.40 | 1.39 | 1.42 | 1.38 | 1.40 | 1.42 |
| After 40,000 pieces | 1.38 | 1.42 | 1.37 | 1.40 | 1.41 | 1.38 | 1.41 | 1.43 | 1.38 | 1.41 | 1.40 |
| After 80,000 pieces | 1.40 | 1.40 | 1.36 | 1.38 | 1.39 | 1.41 | 1.41 | 1.43 | 1.36 | 1.39 | 1.41 |
| Fogging density | | | | | | | | | | | |
| First | 0.003 | 0.004 | 0.003 | 0.004 | 0.004 | 0.002 | 0.003 | 0.003 | 0.003 | 0.003 | 0.002 |
| After 10,000 pieces | 0.002 | 0.003 | 0.003 | 0.003 | 0.002 | 0.002 | 0.004 | 0.002 | 0.004 | 0.003 | 0.001 |
| After 40,000 pieces | 0.001 | 0.003 | 0.002 | 0.003 | 0.004 | 0.001 | 0.002 | 0.002 | 0.003 | 0.002 | 0.002 |
| After 80,000 pieces | 0.002 | 0.002 | 0.002 | 0.002 | 0.003 | 0.003 | 0.002 | 0.003 | 0.003 | 0.002 | 0.002 |
| Transfer efficiency (%) | 84.6 | 81.7 | 83.4 | 82.3 | 81.1 | 85.0 | 85.1 | 84.3 | 85.2 | 83.6 | 86.6 |
| Scattering of toner | ○ | ○ | ○ | ○ | ○ | ○ | ○ | ○ | ○ | ○ | ○ |
| Amount spent (mg) | 0.40 | 0.57 | 0.38 | 0.53 | 0.50 | 0.35 | 0.43 | 0.46 | 0.42 | 0.45 | 0.20 |

TABLE 2

| | Comparative Examples | | | | |
|---|---|---|---|---|---|
| | 1 | 2 | 3 | 4 | 5 |
| Coating area ratio (%) | 0 | 0.0007 | 83 | 100 | 72 |
| Electric resistance (Ω) | $4 \times 10^7$ | $4 \times 10^7$ | $8 \times 10^{10}$ | $5 \times 10^{11}$ | $3 \times 10^{10}$ |
| Amount of charge (μC/g) | | | | | |
| First | −21.2 | −20.3 | −22.3 | −23.5 | −20.4 |
| After 10,000 pieces | −20.3 | −21.1 | −26.0 | −28.3 | −23.4 |
| After 40,000 pieces | −15.8 | −18.3 | −27.4 | −32.3 | −24.5 |
| After 80,000 pieces | −12.4 | −15.4 | −30.2 | −36.6 | −25.0 |
| Image density | | | | | |
| First | 1.43 | 1.44 | 1.26 | 1.28 | 1.30 |
| After 10,000 pieces | 1.42 | 1.42 | 1.18 | 1.22 | 1.24 |
| After 40,000 pieces | 1.45 | 1.45 | 1.15 | 1.18 | 1.20 |
| After 80,000 pieces | 1.48 | 1.47 | 1.14 | 1.10 | 1.21 |
| Fogging density | | | | | |
| First | 0.008 | 0.005 | 0.002 | 0.001 | 0.002 |
| After 10,000 pieces | 0.007 | 0.006 | 0.001 | 0.002 | 0.002 |
| After 40,000 pieces | 0.012 | 0.010 | 0.003 | 0.001 | 0.003 |
| After 80,000 pieces | 0.015 | 0.013 | 0.002 | 0.003 | 0.002 |
| Transfer efficiency (%) | 57.3 | 70.3 | 78.0 | 79.2 | 80.8 |
| Scattering of toner | X | X | ○ | ○ | ○ |
| Amount spent (mg) | 1.18 | 0.77 | 0.41 | 0.44 | 0.63 |

We claim:

1. A magnetic carrier for an electrophotographic developing agent comprising magnetic core particles and a resin-coated layer provided on the surfaces of the core particles, wherein the resin-coated layer comprises a thermosetting resin and a thermoplastic resin or wax, said thermoplastic resin or wax having a melting point or softening point lower than the thermosetting temperature of the thermosetting resin, and said resin-coated layer comprises the thermosetting resin and the thermoplastic resin or wax at a weight ratio of from 99.5:0.5 to 51:49, the resin-coated layer filling the recessed portions of the core particles and forming a partial coating layer having a coating area ratio of from 0.1 to 60%, wherein the resin-coated layer is in an amount of from 0.01 to 2.0% by weight based on the weight of the magnetic core particles.

2. A magnetic carrier according to claim 1, wherein said thermoplastic resin or wax has a melting point or softening point less than 150° C.

3. A magnetic carrier according to claim 1, wherein said magnetic core particles are sintered ferrite particles having a diameter of from 50 to 150 μm.

4. A magnetic carrier according to claim 1, wherein said thermosetting resin is a modified or unmodified silicone resin, a thermosetting acrylic or acrylic-styrene resin, a phenol resin, an urethane resin, a thermosetting polyester resin, an epoxy resin or an amino resin.

5. A magnetic carrier according to claim 1, wherein said thermoplastic resin or wax is a thermoplastic acrylic or acrylic-styrene resin, an ethylene copolymer resin or wax, a polyamide resin or a polyester resin having a melting or softening temperature of less than 150° C.

6. A magnetic carrier according to claim 1, wherein the resin-coated layer is in an amount of 0.05 to 1.5% by weight based on the weight of the magnetic core particles.

7. A magnetic carrier according to claim 1, wherein the resin-coated layer comprises the thermosetting resin and the thermoplastic resin or wax at a weight ratio of from 99:1 to 90:10.

8. A magnetic carrier according to claim 1, wherein the resin-coated layer fills the recessed portions of the core particles and forms a partial coating layer having a coating area ratio of from 1.0 to 50%.

9. A magnetic carrier according to claim 1, wherein said magnetic core particles have a volume resistivity of from $10^7$ to $10^8$ Ω·cm.

10. A magnetic carrier for an electrophotographic developing agent comprising magnetic core particles and a resin-coated layer provided on the surfaces of the core particles, wherein the resin-coated layer comprises a thermosetting resin and a thermoplastic resin or wax, said thermoplastic resin or wax having a melting point or softening point lower than the thermosetting temperature of the thermosetting resin, and said resin-coated layer comprises the thermosetting resin and the thermoplastic resin or wax at a weight ratio of from 99.1 to 90:10, the resin coated layer filling the recessed portions of he core particles and forming a partial coating layer having a coating area ratio of from 1.0 to 50%, wherein the resin-coated layer is in an amount of from 0.05 to 1.5% by weight based on the weight of the magnetic core particles.

11. A magnetic carrier according to claim 10, wherein said thermoplastic resin or wax has a melting point or softening point less than 150° C.

12. A magnetic carrier according to claim 10, wherein said magnetic core particles are sintered ferrite particles having a diameter of from 50 to 150 μm.

13. A magnetic carrier according to claim 10, wherein said thermosetting resin is a modified or unmodified silicone resin, a thermosetting acrylic or acrylic-styrene resin, a phenol resin, an urethane resin, a thermosetting polyester resin, an epoxy resin or an amino resin, and wherein said thermoplastic resin or wax is a thermoplastic acrylic or acrylic-styrene resin, an ethylene copolymer resin or wax, a polyamide resin or a polyester resin.

14. A magnetic carrier according to claim 10, wherein the resin-coated layer is in an amount of 0.10 to 1.0% by weight based on the weight of the magnetic core particles.

15. A magnetic carrier according to claim 10, wherein the resin-coated layer fills the recessed portions of the core particles and forms a partial coating layer having a coating area ratio of from 5 to 45%.

16. A magnetic carrier according to claim 10, wherein said magnetic core particles have a volume resistivity of from $10^7$ to $10^8$ Ω·cm.

17. A method of producing a magnetic carrier for an electrophotographic developing agent containing magnetic core particles and a resin-coated layer on the surface of the core particles which comprises applying to the magnetic core particles a solution or a dispersion of a resin composition comprising a thermosetting resin and a thermoplastic resin or wax, said thermoplastic resin or wax having a melting point or softening point lower than the thermosetting temperature of the thermosetting resin, and said resin-coated layer comprises the thermosetting resin and the thermoplastic resin or wax at a weight ratio of from 99:1 to 90:10, and heating the resin composition on the surfaces of the magnetic core particles at a temperature which is not lower than the melting point of the thermoplastic resin and is not lower than the thermosetting temperature of the thermosetting resin, filling the recessed portions of the magnetic core particles and forming a partial coating layer on the surfaces of the magnetic core particles having a coating area ratio of from 1 to 50%, wherein the resin-coated layer is in an amount of from 0.01 to 2.0% by weight based on the weight of the magnetic core particles.

18. A method of producing a magnetic carrier according to claim 17, wherein the thermoplastic resin or wax has a melting point or softening point less than 150° C.

19. A method of producing a magnetic carrier according to claim 17, wherein the resin-coated layer is in an amount of from 0.05 to 1.5% by weight based on the weight of the magnetic core particles.

20. A method of producing a magnetic carrier according to claim 17, wherein said magnetic core particles have a volume resistivity of from $10^7$ to $10^8$ Ω·cm.

* * * * *